US006613989B2

(12) United States Patent
Tsuda et al.

(10) Patent No.: US 6,613,989 B2
(45) Date of Patent: Sep. 2, 2003

(54) MULTI-DIRECTIONAL SWITCH AND APPARATUS USING THE SAME

(75) Inventors: Tatsuya Tsuda, Fukui (JP); Yasuchika Kudo, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 111 days.

(21) Appl. No.: 09/934,593

(22) Filed: Aug. 23, 2001

(65) Prior Publication Data

US 2002/0023827 A1 Feb. 28, 2002

(30) Foreign Application Priority Data

Aug. 23, 2000 (JP) ..... 2000-252097

(51) Int. Cl.[7] ..... H01H 9/00

(52) U.S. Cl. ..... 200/4; 200/6 A; 200/534; 200/557; 200/275; 200/17

(58) Field of Search ..... 200/4, 5 R, 6 R, 200/6 A, 17, 18, 335, 339, 341, 534, 535, 542, 553, 559, 569, 283

(56) References Cited

U.S. PATENT DOCUMENTS 2,808,476 A * 10/1957 Elliott ..... 200/6
3,479,478 A * 11/1969 Robbins ..... 200/153
4,463,233 A * 7/1984 Tanabe ..... 200/159 A
4,760,221 A * 7/1988 Yoshida et al. ..... 200/67 D
5,075,524 A 12/1991 Klatt et al.
5,280,145 A * 1/1994 Mosier et al. ..... 200/313
5,889,242 A * 3/1999 Ishihara et al. ..... 200/6 A
6,080,941 A 6/2000 Yokobori
6,118,086 A 9/2000 Isikawa
6,124,555 A 9/2000 Isikawa
6,399,904 B1 * 6/2002 Mimata ..... 200/6 A

FOREIGN PATENT DOCUMENTS

JP 11-120868 4/1999

* cited by examiner

*Primary Examiner*—Elvin Enad
*Assistant Examiner*—K. Lee
(74) *Attorney, Agent, or Firm*—Wenderoth, Lind & Ponack, L.L.P.

(57) ABSTRACT

A multidirectional switch includes (a) a case having a common contact and plural fixed contacts; (b) a contacting unit whose intermediate section is in contact with the common contact, and a tip of an arm extending from the intermediate section faces one of the fixed contacts at a given interval; (c) a spring placed on the contacting unit, and an end of a movable section at an intermediate section of the spring being in contact with the tip of the arm, and a bowed section extending from the movable section being retained by the case; (d) a cover with a hole for covering the case; and (e) an operating unit having a depressing section, being mounted movably to the case or the cover, and the depressing section extending through the hole of the cover for being brought into contact with the end of the movable section of the spring.

16 Claims, 10 Drawing Sheets

MULTI-DIRECTIONAL SWITCH AND APPARATUS USING THE SAME

FIELD OF THE INVENTION

The present invention relates to a multidirectional switch employed typically in portable-communicating apparatuses including cellular phones and personal handy-phone systems (PHS), and it also relates to an apparatus using the multidirectional switch.

BACKGROUND OF THE INVENTION

Recently, portable-communicating apparatuses such as cellular phones and PHSs have been increasingly demanded because of their conveniences, and at the same time, the market has required that the portability as well as usability of those apparatuses be improved. This market trend entails the apparatuses to employ multidirectional switches which a user rocks and depresses to manipulate the apparatus.

A conventional multidirectional switch is disclosed in Japanese Patent Application Unexamined Publication No. H11-120868. This conventional switch is described here with reference to FIG. 10, a cross sectional view of this switch.

In FIG. 10, case 1 shapes in a box having an opening in the upper face. On the inner bottom face of case 1, a plurality of fixed contacts 2 are disposed. Case 1 houses slider 3 in a sidable manner. Contacting unit 4, somewhat bent and of which both the ends being elastically in contact with the inner bottom of case 1, is mounted to the lower face of slider 3. The upper side of case 1 is covered by cover 5, above which operating unit 6 is mounted to case 1 such that operating unit 6 can be rocked and moved up and down with respect to the orthogonal direction to the rocking direction. Spring 7 is mounted between operating unit 6 and cover 5. Push switch 8 is placed under operating unit 6 at right-hand side. The conventional multidirectional switch is thus constructed.

In the construction discussed above, when operating unit 6 is rocked back and forth, slider 3 slides in case 1, so that fixed contacts 2 are electrically opened/closed via contacting unit 4. On the other hand, when operating unit 6 is depressed downward, the lower face thereof depresses push-button switch 8, thereby closing/opening switch 8.

The multidirectional switch discussed above is mounted to a portable communicating-apparatus such as a cellular phone or a PHS, and rocking operation of operating unit 6 moves and searches personal names or phone numbers listed in a screen of the apparatus. Then a depressing operation of operating unit 6 selects a name or a phone number out of the list before the user starts a phone call.

This conventional multidirectional switch is a thin type and yet gains a great stroke at an rocking operation. However, it includes a rocking switch which comprises (a) contacting unit 4 retained by slider 3 and (b) fixed contacts 2 disposed in case 1, and it also includes a depressing switch which comprises (c) operating unit 6 and (d) push-button switch 8. As such, since the conventional switch has many elements, it is difficult for this multidirectional switch to be downsized, and it requires much time to assemble.

SUMMARY OF THE INVENTION

The present invention addresses the problems discussed above and aims to provide an inexpensive, downsized and easy-to-assemble multidirectional switch, and an apparatus using this multidirectional switch.

The multidirectional switch of the present invention comprises the following elements:

(a) a case having a common contact and a plurality of fixed contacts;

(b) a contacting unit of which intermediate section is brought into contact with the common contact, and arms extending from the intermediate section having tips facing the fixed contacts at a given interval;

(c) a spring disposed on the contacting unit, and both the ends of a movable section at an intermediate section thereof being brought into contact with the tip of the arm, and a bowed section extending from the movable section being retained by the case;

(d) a cover for covering the case, and having a hole; and (e) an operating unit having a depressing section and being mounted to either the case or the cover in a movable manner, and the depressing section being brought into contact with the ends of the movable section of the spring via the hole of the cover.

This structure allows a multidirectional switch to be assembled simply and inexpensively with less components, and downsized.

DETAILED DESCRIPTION OF THE INVENTION

The following instance is one of structures of the multidirectional switch of the present invention:

(a) a box-shaped case having an opening in the upper face, a common contact and a plurality of fixed contacts disposed on the inner bottom face;

(b) an approx. S-shaped contacting unit of which intermediate section is brought into contact with the common contact at its lower face, and arms extending from both the ends of the intermediate section and having the arms' tips facing the fixed contacts at a given interval;

(c) an approx. S-shaped spring disposed on the contacting unit, and a lower faces of ends of a movable section at an intermediate section thereof being brought into contact with the tips of the arms, and bowed arms extending from both the ends of the movable section in somewhat bowed manner being retained by the inner wall of the case;

(d) a cover for covering the case, and having an opening in the upper face; and (e) an operating unit mounted to either the case or the cover in a rockable manner and movable up and down, a depressing section disposed on the lower face thereof being brought into contact with ends of the movable section of the spring via the hole of the cover.

When the operating unit of this structure discussed above is rocked or depressed, the contacting unit depressed by the spring couples the common contact to one of the fixed contacts at the rocking operation, while the contacting unit couples the common contact to the fixed contacts at the depressing operation. Thus one set of the spring and the contacting unit opens/closes the switch electrically at the rocking operation or the depressing operation. The present invention can provide a downsized multidirectional switch featuring less components, an inexpensive cost, and easy-to-assemble.

More specific exemplary embodiments of the present invention are demonstrated hereinafter with reference to the accompanying drawings.

First Exemplary Embodiment

Figure 1:
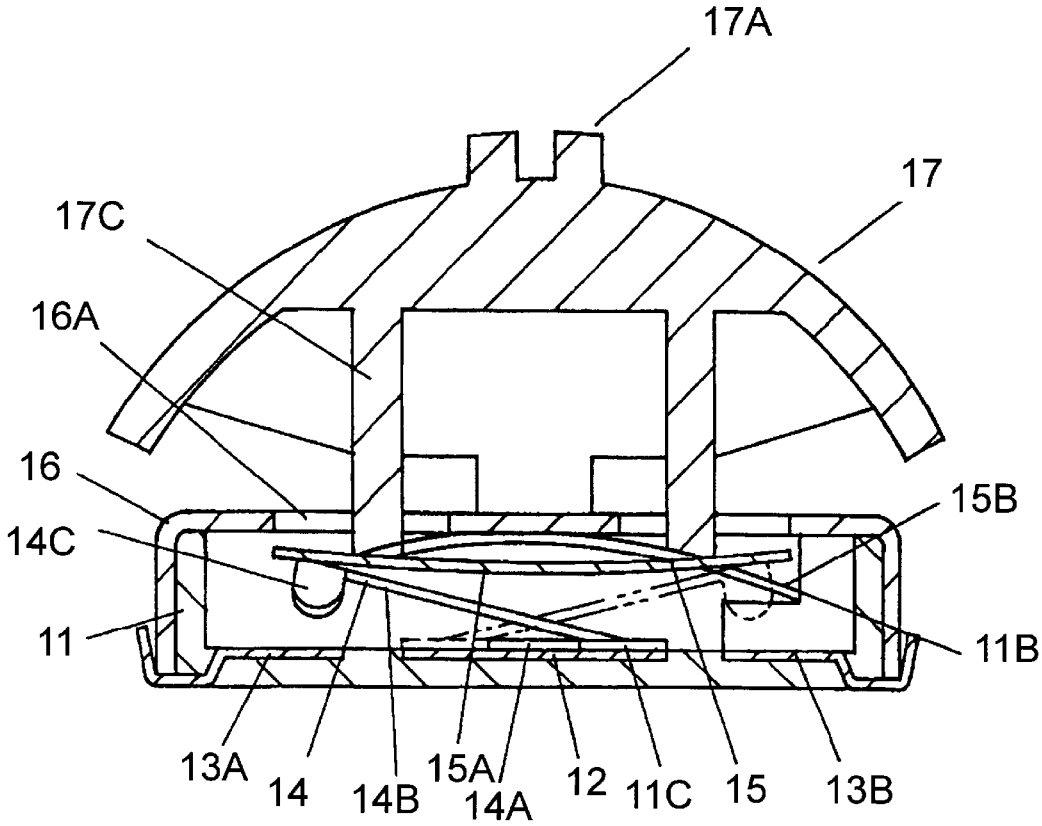
FIG. 1 is a lateral cross section of a multidirectional switch in accordance with a first exemplary embodiment of the present invention.
Figure 2:
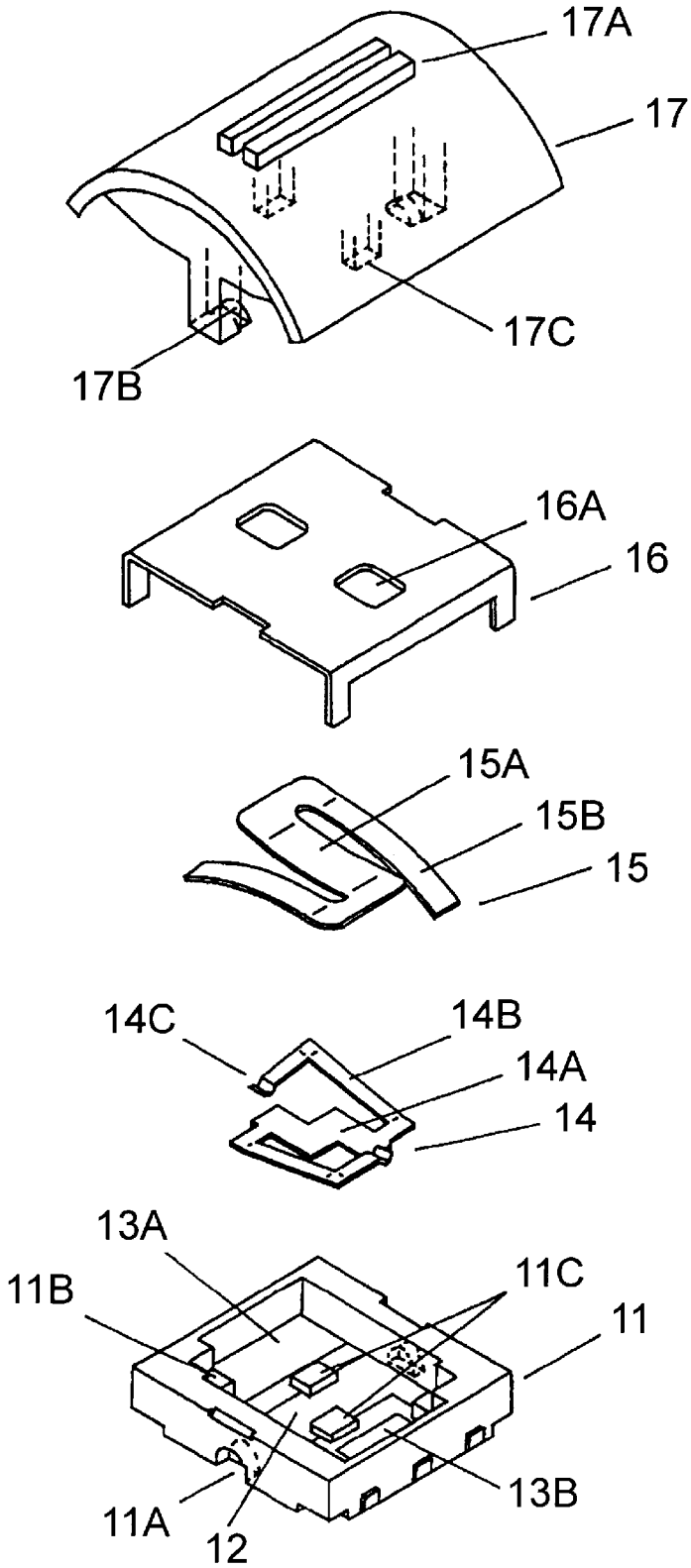
FIG. 2 is an exploded perspective view of the switch shown in FIG. 1.
Figure 3:
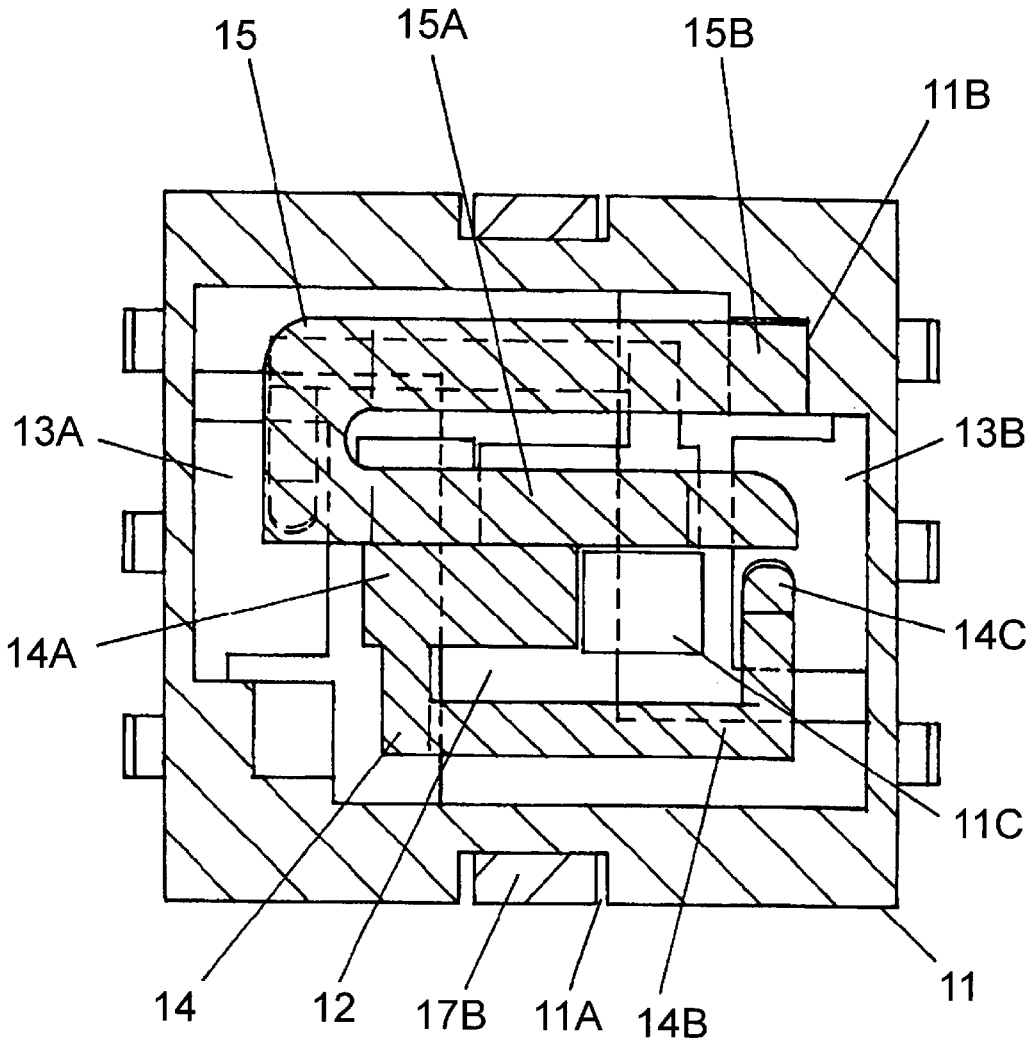
FIG. 3 is a plan cross sectional view of the switch shown in FIG. 1.
Figure 4:
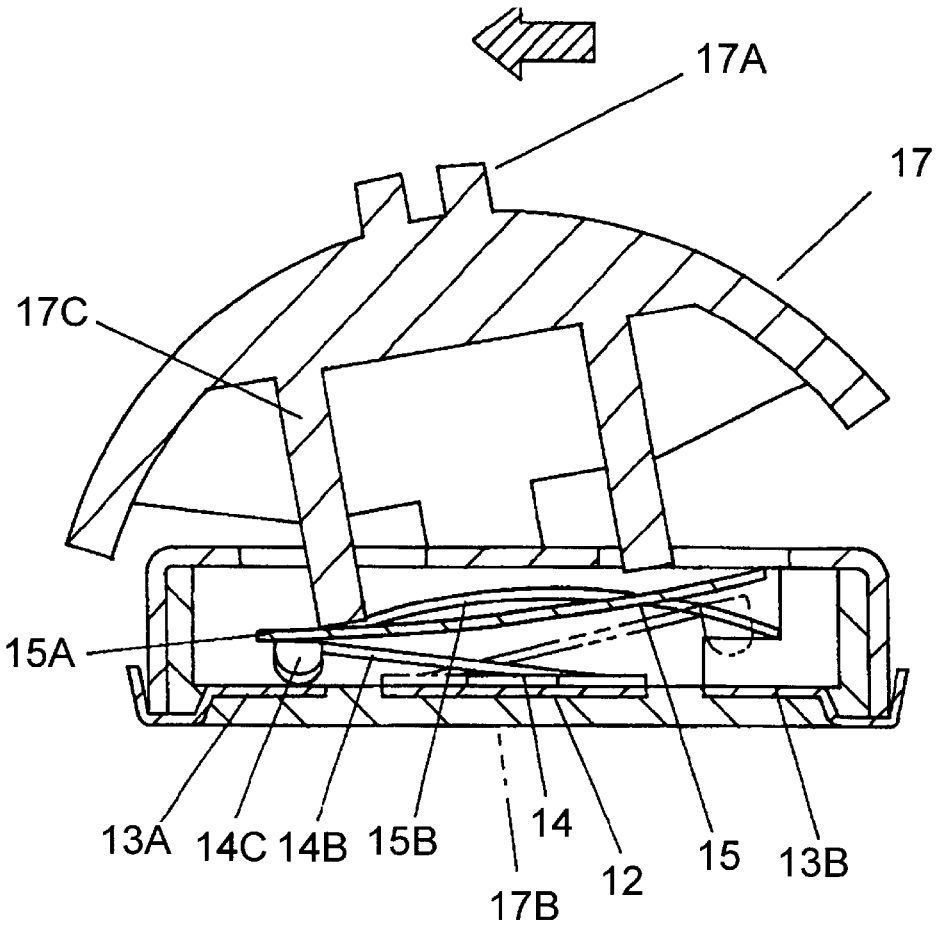
FIG. 4 is a lateral cross section of the switch, shown in FIG. 1, being rocked.
Figure 5:
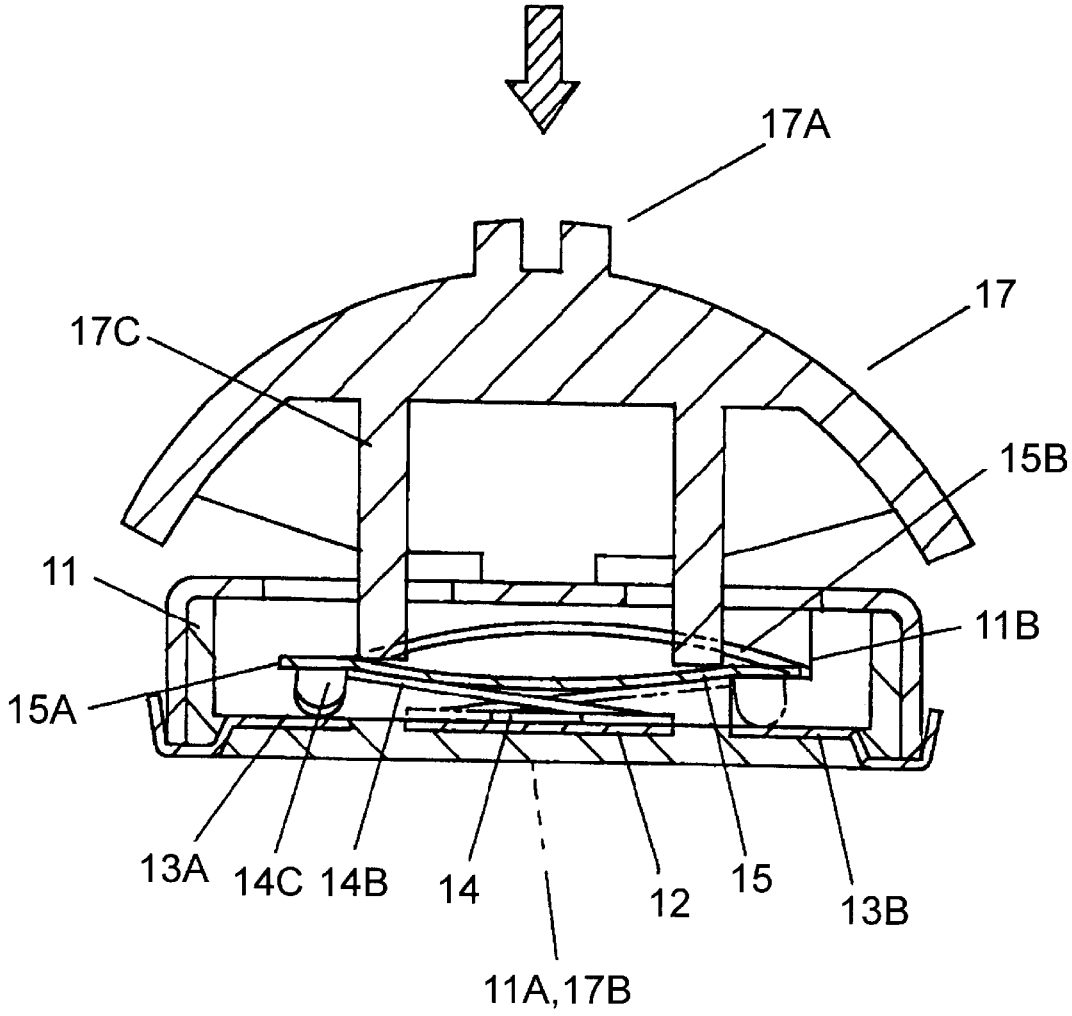
FIG. 5 is a lateral cross section of the switch, shown in FIG. 1, being depressed.

FIG. 1 is a lateral cross section of a multidirectional switch in accordance with the first exemplary embodiment of the present invention. FIG. 2 is an exploded perspective view of the switch shown in FIG. 1. FIG. 3 is a plan cross sectional view of the same switch. FIG. 4 is a lateral cross section of the same switch being rocked. FIG. 5 is a lateral cross section of the same switch being depressed.

In FIG. 1, box-shaped case 11 made of insulating resin has an opening in the upper face. As shown in FIG. 2, two supporting sections 11A shaped in an approx. semicircle are provided respectively to both sides of the outer wall of case 11. Two engaging sections 11B are formed at the corners of inner wall of case 11, and the two engaging sections face each other approx. diagonally.

At the approx. center of the inner bottom face of case 11, common contact 12 made of conductive metal is disposed, and fixed contacts 13A and 13B are disposed at both sides of common contact 12 at given intervals. The respective ends of each of those contacts are led out from the outer wall of case 11 and are ready to be coupled to external electric circuits (not shown.)

Contacting unit 14 shapes in an approx. S-letter and is made of elastic thin metal plate. Intermediate sections 14A of contacting unit 14 are inserted between two protrusions 11C formed on the inner bottom face of case 11. The lower face of intermediate section 14A is placed on common contact 12. Arms 14B extend from both the ends of intermediate section 14A in opposite directions with each other. Each of arms 14B shapes in an approx. L-letter, and both the tips of arms 14B have arc-shaped movable contacts 14C respectively. Both movable contacts 14C face respective fixed contacts 13A and 13B at a given interval.

Spring 15 is made of elastic thin metal plate and shapes in an approx. S-letter. Spring 15 is placed on contacting unit 14. The lower faces of both the ends of movable section 15A of the intermediate section of spring 15 are brought into contact with both tips 14C of respective arms 14B of contacting unit 14. At the same time, each of the arms 15B is elastically brought into contact with the inner wall of engaging sections 11B, so that each arm 15B is retained within case 11. Arms 15B extend from both ends of movable section 15A in opposite directions with each other, and arms 15B are somewhat bowed upward.

Cover 16 covers the upper face of case 11. Operating unit 17 made of insulating resin includes operating section 17A on its upper face. Fulcrums 17B protruded semi-circularly from the lower ends of both the sides of operating unit 17 are inserted into supporting sections 11A of case 11. Operating unit 17 is thus mounted to case 11 in a rockable manner and movable up and down with respect to the direction orthogonal to the rocking direction.

Two depressing sections 17C extend downward from the lower face of operating unit 7. Both depressing sections 17C extend through holes 16A provided to the upper face of cover 16, and the tips of both depressing sections 17 are brought into contact with both the respective ends of movable sections 15A of spring 15.

Operation of the multidirectional switch structured above and in accordance with the first embodiment is demonstrated hereinafter. When operating section 17A is rocked toward left from the neutral position shown in FIG. 1, operating unit 17 is rocked toward left on fulcrum 17B at the lower end of operating unit 17 as shown in FIG. 4. Then depressing section 17C at lower left in FIG. 4 depresses the left end of movable section 15A of spring 15. First movable contact 14C of first arm 14B—extending from contacting unit 14 which is depressed by the lower face of depressing section 17C—is brought into contact with fixed contact 13A, and common contact 12 is coupled electrically to fixed contact 13A via contacting unit 14.

When the rocking operation is released, operating unit 17 springs back toward right due to resilient restoring force of bowed arm 15B of spring 15 which is depressed by depressing section 17C. Contacting unit 14 also springs back to the neutral position shown in FIG. 1, for movable contact 14C leaves fixed contact 13A due to resilient restoring force of arm 14B.

On the contrary, when operating section 17A is rocked toward right, operating unit 17 is also rocked toward right. Then depressing section 17C depresses the right end of movable section 15A of spring 15, so that second arm 14B of contacting unit 14 is depressed. Second movable contact 14C is brought into contact with fixed contact 13B, and common contact 12 is coupled to fixed contact 13B electrically via contacting unit 14.

When operating section 17A is depressed downward from the neutral position shown in FIG. 1, fulcrum 17B at the lower end of operating unit 17 moves downward in supporting section 11A as shown in FIG. 5, which entails two depressing sections 17C to depress both the ends of movable section 15A of spring 15. Then arms 14B on both sides of contacting unit 14 are depressed downward, and both the movable contacts 14C at the tips of arms 14B are brought into contact with fixed contacts 13A and 13B. Thus common contact 12 is coupled electrically to fixed contact 13A and 13B respectively via contacting unit 14.

At this time, downward movement and the resulting bend of movable section 15A of spring 15 entails bowed arm 15B, of which respective tips elastically contact to the inner wall of engaging section 11B of case 11, to bend, so that excessive closing force to operating unit 17 can be prevented.

When the operating force is released, operating unit 17 springs back upward due to elastic restoring force of bowed arm 15B of spring 15. At the same time, movable contacts 14C on both the sides of arms 14B leave fixed contacts 13A and 13B, and contacting unit 14 restores to the neutral position shown in FIG. 1.

The multidirectional switch structured above is mounted to, e.g., portable-communicating apparatus such as a cellular phone or a PHS. When the switch is in use in such an apparatus, common contact 12 is coupled electrically to fixed contact 13A or 13B by the rocking operation of operating unit 17. Then a name list or a phone-number list displayed on the screen is moved and searched, and desirable information is selected by depressing operating unit 17, thereby starting a phone call. This depressing operation couples common contact 12 electrically to fixed contact 13A or 13B.

According to the first embodiment, contacting unit 14 depressed by spring 15 couples common contact 12 to one of fixed contact 13A or 13B by a rocking operation, while contacting unit 14 couples common contact 12 to both of fixed contacts 13A and 13B by a depressing operation. Therefore, electrical on/off by the rocking operation and the depressing operation can be done only with spring 15 and contacting unit 14. A downsized multidirectional switch featuring an inexpensive cost and easy-to-assemble with less components is thus obtainable.

Second Exemplary Embodiment

Figure 6:
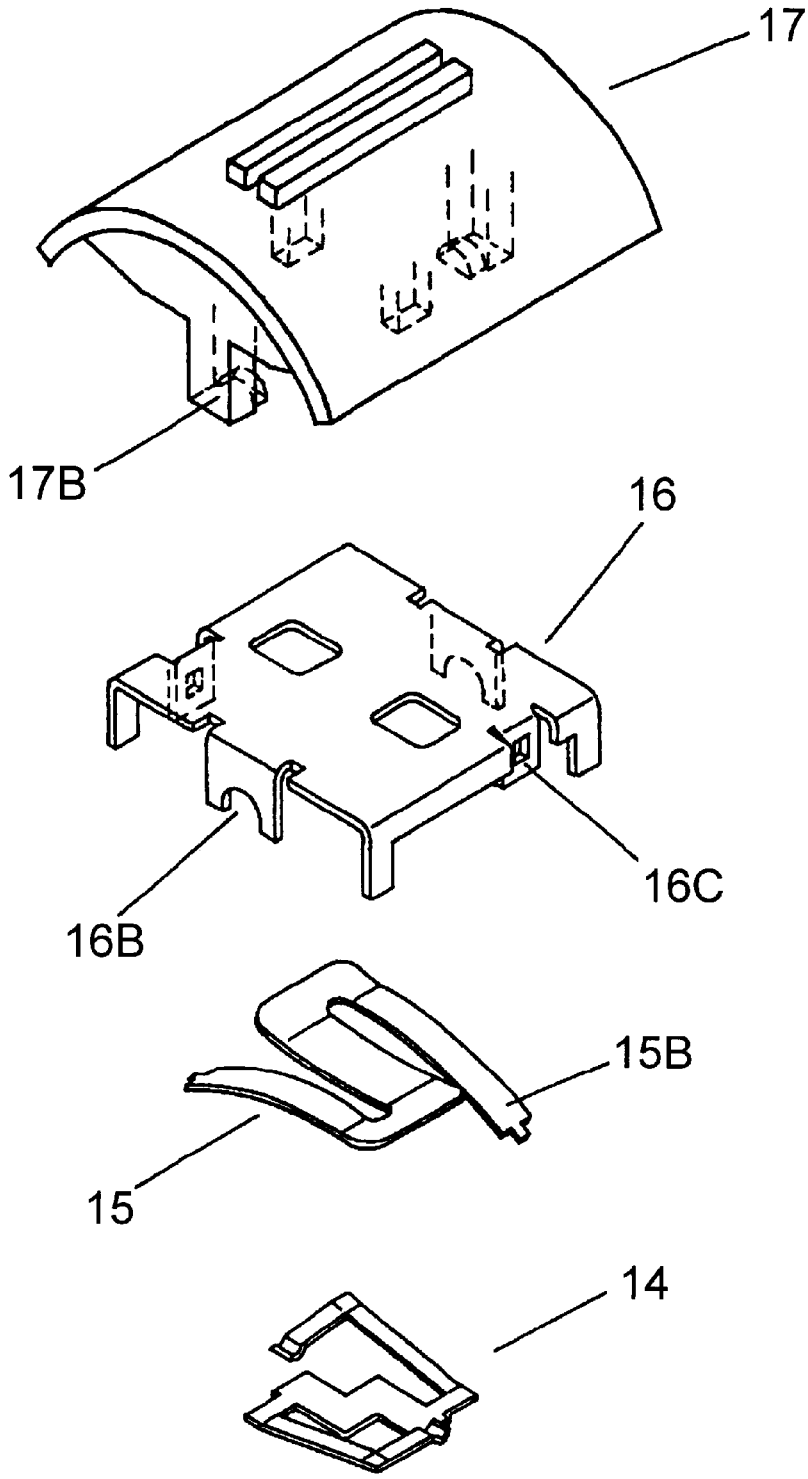
FIG. 6 is an exploded perspective view of a multidirectional switch in accordance with a second exemplary embodiment of the present invention.

FIG. 6 is an exploded perspective view of a multidirectional switch in accordance with the second exemplary embodiment of the present invention. In the first embodiment discussed previously, fulcrum 17B is inserted into supporting section 11A, whereby operating unit 17 is mounted to case 11 such that operating unit 17 can be rocked and is movable up and down. At the same time, the tips of respective bowed arms 15B of spring 15 are brought into elastically contact with the inner wall of engaging section 11B of case 11. In this second embodiment; however, supporting sections 16B are formed on both sides of cover 16 as shown in FIG. 6, so that fulcrums 17B of operating unit 17 are mounted to supporting sections 16B in a rockable manner and movable up and down.

As shown in FIG. 6, engaging sections 16C are provided on both sides of cover 16, thereby retaining the tips of bowed arms 15B. This structure allows the switch to be assembled by overlaying cover 16, which retains spring 15, on case 11 which houses contacting unit 14.

Further, in the above embodiments, two depressing sections 17C are formed beneath the lower face of operating unit 17, so that depressing sections 17C are brought into contact with both the ends of movable section 15A of spring 15. However, a depressing section having a certain width is formed at the center of the lower face of operating unit 17, so that both the ends of this depressing section can depress the upper surface of movable section 15A at the rocking operation.

Third Exemplary Embodiment

Figure 7:
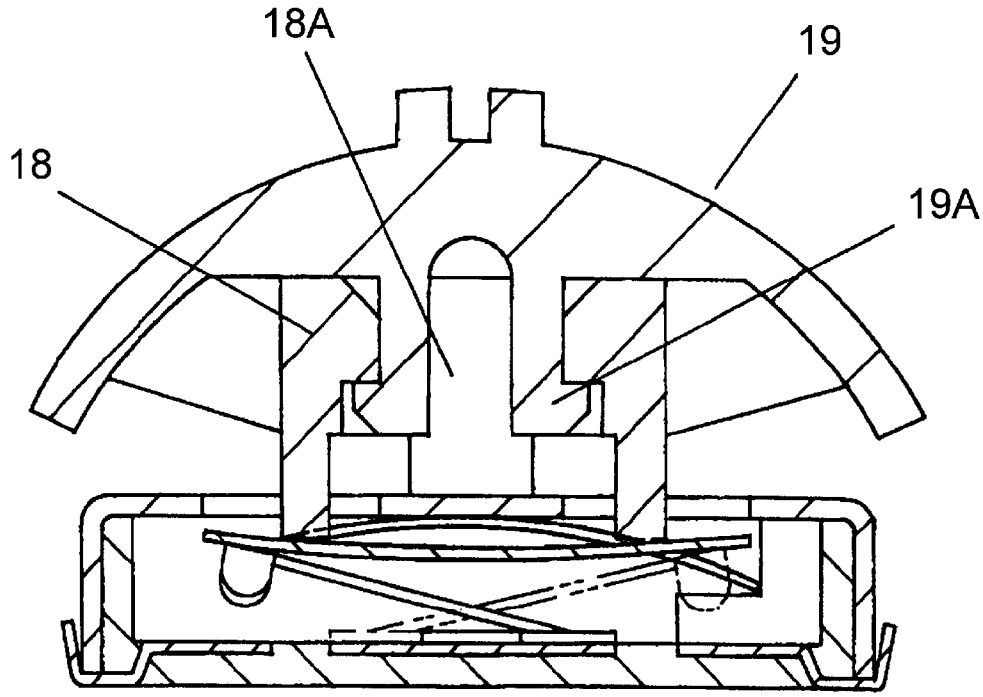
FIG. 7 is a lateral cross section of a multidirectional switch in accordance with a third exemplary embodiment of the present invention.

FIG. 7 is a lateral cross section of a multidirectional switch in accordance with the third exemplary embodiment of the present invention. The third embodiment differs from the first one in the operating unit. As shown in FIG. 7, in the third embodiment, engaging hole 18A is provided to operating unit 18, and engaging claws 19A formed at lower face of operating button 19 are inserted into engaging hole 18A, so that button 19 is detachably mounted to the upper section of operating unit 18. This structure allows the switch to be mounted with various shapes and colors of button 19, and operating unit 18 can be unified regardless of various shapes and colors of button 19. As a result, the operating unit can be commonly used by various apparatuses.

Fourth Exemplary Embodiment

Figure 8:
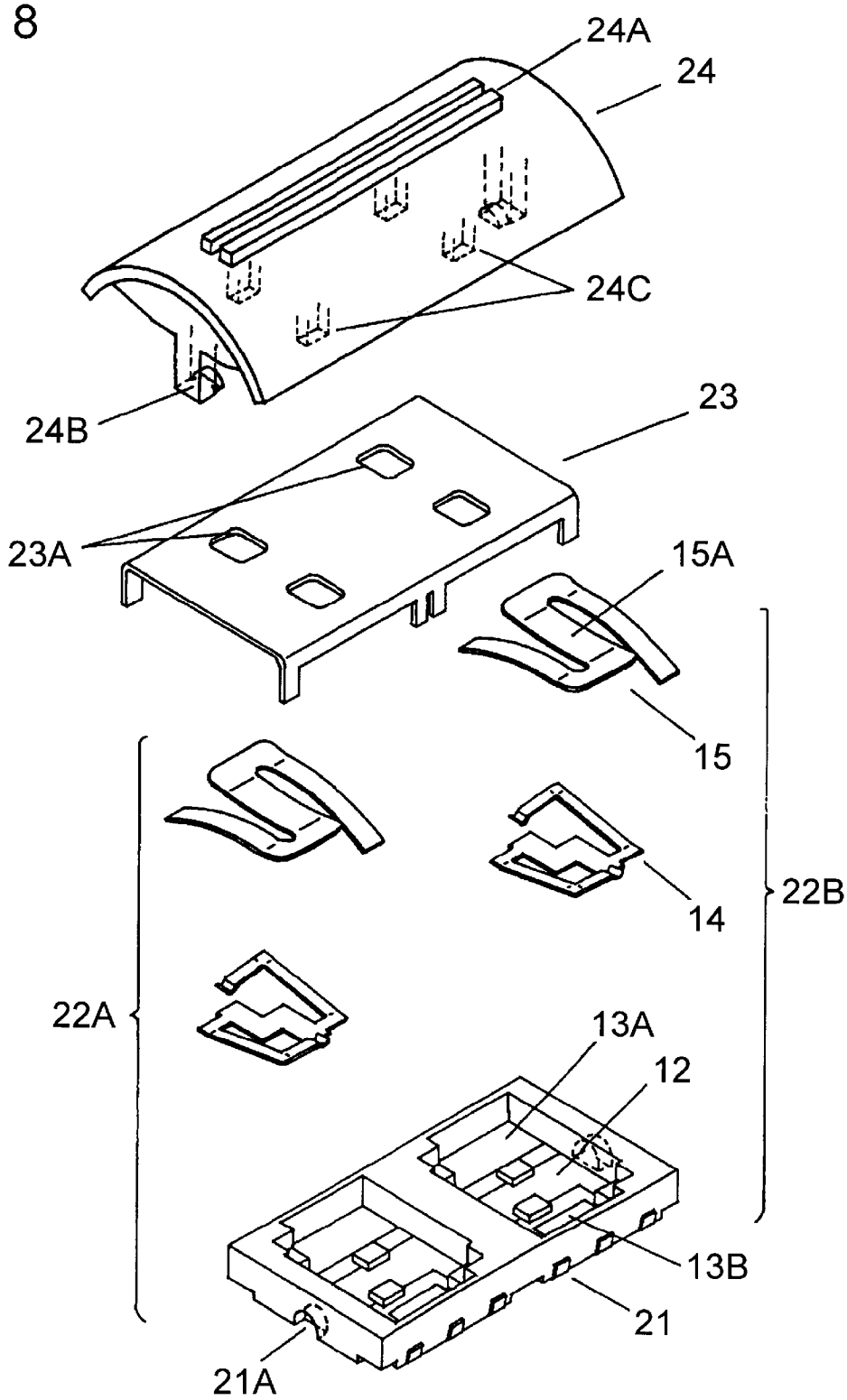
FIG. 8 is an exploded perspective view of a multidirectional switch in accordance with a fourth exemplary embodiment of the present invention.

FIG. 8 is an exploded perspective view of a multidirectional switch in accordance with the fourth exemplary embodiment of the present invention. The elements similar to those in the first embodiment have the same reference marks, and the descriptions of those elements are omitted.

In FIG. 8, case 21 made of insulating resin is formed of plurality of box-shaped cases 11 described in the first embodiment, i.e., each of cases 11 is treated as one block and the plural blocks are integrated into one unit. Supporting sections 21A shaping in an approx. semicircle are provided on both sides of the outer wall of case 21.

Each of respective blocks has common contact 12 at its approx. center on the inner bottom face, and fixed contacts 13A and 13B on both sides of common contact 12. Contacting unit 14 and spring 15 are provided respectively to each of fixed contacts 13A and 13B, thereby forming a plurality of switch contacts 22A and 22B.

Cover 23 covers plural openings of upper faces of case 21, and operating unit 24 is disposed over cover 23, and mounted to case 21 by inserting fulcrums 24B provided at both lower ends of unit 24 into supporting sections 21A of case 21. Operating unit 24 can be rocked, and is movable up and down in a direction orthogonal to the rocking direction.

Beneath the lower face of operating unit 24, a plurality of pair of depressing sections 24 protruding downward are provided. Those depressing sections 24 extend through a plurality of holes 23A punched on the upper face of cover 23, and respective tips of depressing sections 24 are brought into contact with both the ends of movable sections 15A of respective springs 15.

Operation of the multidirectional switch structured above is described hereinafter. When operating section 24A of operating unit 24 is rocked, depressing sections 24C depress movable sections 15A. At this time, since the plurality of depressing sections 24C depress the plurality of springs 15, the plurality of common contacts 12 are brought into contact with fixed contact 13A or 13B by the plurality of contacting units 14, thereby closing/opening electrically the plurality of switch contacts 22A and 22B simultaneously.

At an depressing operation, when the center of operating unit 24 is depressed downward, the plurality of depressing sections 24C move downward simultaneously, so that the plurality of common contacts 12 are brought into contact with fixed contacts 13A and 13B. As a result, the plurality of switch contacts 22A and 22B are closed simultaneously. On the other hand, when the left end or the right end of operating unit 24 is depressed, the depressing section 24C only on the depressed side moves downward, so that switch contact 22A or 22B is electrically closed.

The multidirectional switch in accordance with the fourth embodiment is employed in a portable-communicating apparatus such as a cellular phone or a PHS. The switch is then rocked with operating unit 24 for moving and searching a name list or a phone number list displayed on a screen of the apparatus. Thus the switch is used in the same application described in the first embodiment. However, in this fourth embodiment, since the plurality of switch contacts 22A and 22B are closed/opened simultaneously, when the information displayed on the screen is moved, for example, by switch contact 22A. At the same time, a lamp or an LED is switched by switch contact 22B for illuminating the screen.

On the other hand, the switch is depressed with operating unit 24 for selecting a name or a phone number before the user starts a phone call, or a rocking operation moves a cursor up and down. Then depressing either end of operating unit 24 moves the cursor side to side. These are examples of applications.

As discussed above, according to the fourth embodiment, a plurality of common contacts 12 and fixed contacts 13A, 13B are provided in addition to a plurality of contacting units 14 and springs 15, thereby forming a plurality of switch contacts 22A and 22B. The switch contacts are electrically closed/opened by a rocking or a depressing operation with operating unit 24. The plurality of switch contacts can be thus electrically closed/opened by manipulating just one operating unit 24. As a result, a multidirectional switch for switching versatile functions of the apparatus is obtainable.

Fifth Exemplary Embodiment

Figure 9:
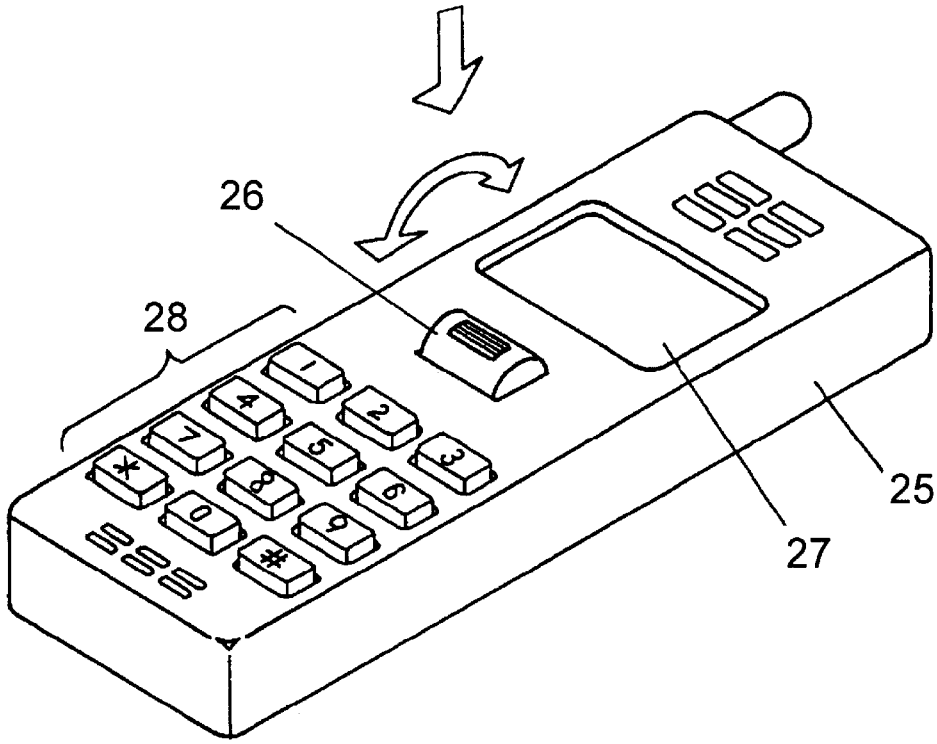
FIG. 9 is a perspective view of an apparatus in accordance with a fifth exemplary embodiment of the present invention.
Figure 10:
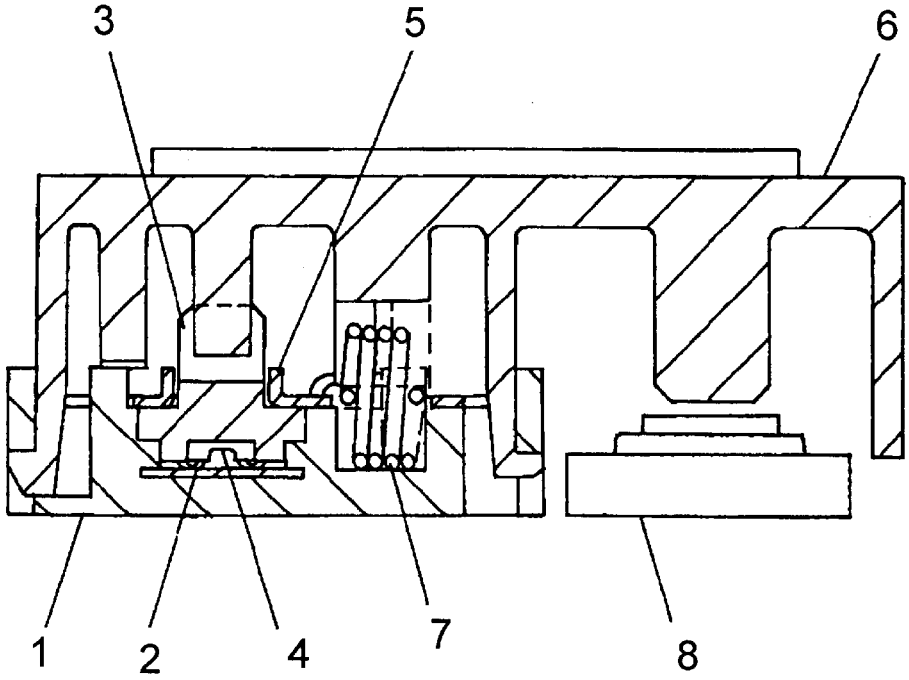
FIG. 10 PRIOR ART
FIG. 10 is a cross section of a conventional multidirectional switch.

FIG. 9 is a perspective view of an apparatus in accordance with the fifth exemplary embodiment of the present invention. In FIG. 9, housing 25 made of insulating resin has multidirectional switch 26, described in the previous embodiments, at the center of its upper face. Display screen 27 comprises liquid crystal display or the like. A plurality of push-button switches 28 are coupled to a printed circuit board (not shown) housed by housing 25. The printed circuit board includes a micro-computer and electronic components.

The apparatus in accordance with the fifth embodiment is thus constructed and is used as a cellular phone or a PHS. In this construction, when push-button switch 28 is depressed, a corresponding phone number list or a corresponding personal name list stored in the micro computer is displayed on screen 27.

On the other hand, when multidirectional switch 26 is rocked, the names or phone numbers displayed on screen 27 are scrolled, thereby searching necessary information. Then the necessary information is selected by depressing switch 26 before the user starts a phone call.

As such, the fifth embodiment employs multidirectional switch 26 described in the first through fourth embodiments, and moves as well as searches the display on screen 27 by rocking the switch, then selects the necessary information by depressing the switch. This construction of the apparatus is equipped with advantageous operability, and allows the apparatus to search and select the information displayed on the screen with ease.

The present invention thus proves that a downsized multidirectional switch featuring easy-to-assemble with less components at an inexpensive cost is obtainable.

What is claimed is:

1. A multidirectional switch comprising:

a case having a common contact and a plurality of fixed contacts arranged at a first side of said common contact and at a second side of said common contact opposite said first side;

an S-shaped contacting unit having an intermediate section contacting said common contact of said case, and having arms extending from said intermediate section such that tips of said arms face said fixed contacts at predetermined intervals therefrom;

an S-shaped spring arranged on said contacting unit, said spring having a central movable section arranged such that ends of said movable section are operable to contact said tips of said arms, and having a bowed section extending from said movable section so as to be retained by said case;

a cover for covering said case, said cover having holes formed therethrough; and an operating unit having depressing sections extending through said holes of said cover and operable to contact said ends of said movable section of said S-shaped spring so as to urge said tips of said S-shaped contacting unit against said fixed contacts, said operating unit being movably mounted to one of said case and said cover so as to be operable to pivot to a first side whereat said operating unit urges said S-shaped contacting unit against said fixed contact at said first side of said common contact so as to electrically couple said common contact and said fixed contact at said first side of said common contact, and to pivot to a second side whereat said operating unit urges said S-shaped contacting unit against said fixed contact at said second side of said common contact so as to electrically couple said common contact and said fixed contact at said second side of said common contact.

2. The switch of claim 1, wherein said operating unit is movably mounted to one of said case and said cover so as to be further operable to linearly move in up and down directions with respect to said case such that said operating unit simultaneously urges said S-shaped contacting unit against said fixed contacts at both said first side and said second side of said common contact so as to simultaneously electrically couple said common contact to said fixed contacts at both said first side and said second side of said common contact.

3. The switch of claim 1, wherein a tip of said bowed section of said spring is retained by said cover.

4. The switch of claim 1, further comprising an operating button detachably mounted to said operating unit.

5. The switch of claim 1, further comprising a plurality of switch contact units, each of said switch contact units including a common contact, a plurality of fixed contacts arranged at a first side of said common contact and at a second side of said common contact opposite said first side, an S-shaped contacting unit, and an S-shaped spring, said operating unit having a plurality of depressing sections for contacting said ends of said movable section of said S-shaped spring of each of said switch contact units.

6. The switch of claim 1, wherein said S-shaped spring comprises an S-shaped flat spring having a first surface side and a second surface side opposite said first surface side, said S-shaped flat spring being arranged so that an entirety of said first surface side faces away from a bottom surface of said case and so that an entirety of said second surface side faces toward said bottom surface of said case.

7. An apparatus comprising:

an electronic component housing; and a multidirectional switch mounted to said electronic component housing, said multidirectional switch including:

a case having a common contact and a plurality of fixed contacts arranged at a first side of said common contact and at a second side of said common contact opposite said first side;

an S-shaped contacting unit having an intermediate section contacting said common contact of said case, and having arms extending from said intermediate section such that tips of said arms face said fixed contacts at predetermined intervals therefrom;

an S-shaped spring arranged on said contacting unit, said spring having a central movable section arranged such that ends of said movable section are operable to contact said tips of said arms, and having a bowed section extending from said movable section so as to be retained by said case;

a cover for covering said case, said cover having holes formed therethrough; and an operating unit having depressing sections extending through said holes of said cover and operable to contact said ends of said movable section of said S-shaped spring so as to urge said tips of said S-shaped contacting unit against said fixed contacts, said operating unit being movably mounted to one of said case and said cover so as to be operable to pivot to a first side whereat said operating unit urges said S-shaped contacting unit against said fixed contact at said first side of said common contact so as to electrically couple said common contact and said fixed contact at said first side of said common contact, and to pivot to a second side whereat said operating unit urges said S-shaped contacting unit against said fixed contact at said second side of said common contact so as to electrically couple said common contact and said fixed contact at said second side of said common contact.

8. The apparatus of claim 7, wherein said operating unit is movably mounted to one of said case and said cover so as to be further operable to linearly move in up and down directions with respect to said case such that said operating unit simultaneously urges said S-shaped contacting unit against said fixed contacts at both said first side and said second side of said common contact so as to simultaneously electrically couple said common contact to said fixed contacts at both said first side and said second side of said common contact.

9. The apparatus of claim 8, further comprising a screen mounted on said electronic component housing and electrically connected to said multidirectional switch so that said multidirectional switch is operable to display a desired item on said screen by pivoting said operating unit, and said multidirectional switch is operable to select the desired item by linearly moving said operating unit in a downward direction.

10. The switch of claim 7, wherein said S-shaped spring comprises an S-shaped flat spring having a first surface side and a second surface side opposite said first surface side, said S-shaped flat spring being arranged so that an entirety of said first surface side faces away from a bottom surface of said case and so that an entirety of said second surface side faces toward said bottom surface of said case.

11. A multidirectional switch comprising:

a case having a common contact, a first fixed contact arranged at a first side of said common contact, and a second fixed contact arranged at a second side of said common contact opposite said first side;

an S-shaped contacting unit having an intermediate section contacting said common contact of said case, having a first arm extending from said intermediate section such that a tip of said first arm faces said first fixed contact at a predetermined interval therefrom, and having a second arm extending from said intermediate section such that a tip of said second arm faces said second fixed contact at a predetermined interval therefrom;

an S-shaped spring arranged on said contacting unit, said S-shaped spring having a central movable section arranged such that a first end of said movable section is operable to contact said tip of said first arm and so that a second end of said movable section is operable to contact said tip of said second arm, and said S-shaped spring having a bowed section extending from said movable section so as to be retained by said case;

a cover for covering said case, said cover having holes formed therethrough; and an operating unit having depressing sections extending through said holes of said cover and operable to contact said ends of said movable section of said S-shaped spring so as to urge said tips of said arms of said S-shaped contacting unit against said fixed contacts, respectively, said operating unit being movably mounted to one of said case and said cover so as to be operable to pivot to a first side whereat a first one of said depressing sections contacts said first end of said movable section of said S-shaped spring so as to urge said tip of said first arm of said S-shaped contacting unit against said first fixed contact so as to electrically couple said common contact and said first fixed contact, and to pivot to a second side whereat a second one of said depressing sections contacts said second end of said movable section of said S-shaped spring so as to urge said tip of said second arm of said S-shaped contacting unit against said second fixed contact so as to electrically couple said common contact and said second fixed contact.

12. The switch of claim 11, wherein said operating unit is movably mounted to one of said case and said cover so as to be further operable to linearly move in up and down directions with respect to said case such that said depressing sections simultaneously urge said tip of said first arm and said tip of said second arm of said S-shaped contacting unit against both said first fixed contact and said second fixed contact so as to simultaneously electrically couple said common contact to said first fixed contact and said second fixed contact.

13. The switch of claim 11, wherein a tip of said bowed section of said spring is retained by said cover.

14. The switch of claim 11, further comprising an operating button detachably mounted to said operating unit.

15. The switch of claim 11, further comprising a plurality of switch contact units, each of said switch contact units including a common contact, a first fixed contact arranged at a first side of said common contact, and a second fixed contact arranged at a second side of said common contact opposite said first side, an S-shaped contacting unit having a first arm and a second arm, and an S-shaped spring having a central movable section with a first end and a second end, said operating unit having a plurality of depressing sections for contacting said ends of said movable section of said S-shaped spring of each of said switch contact units.

16. The switch of claim 11, wherein said S-shaped spring comprises an S-shaped flat spring having a first surface side and a second surface side opposite said first surface side, said S-shaped flat spring being arranged so that an entirety of said first surface side faces away from a bottom surface of said case and so that an entirety of said second surface side faces toward said bottom surface of said case.

* * * * *

UNITED STATES PATENT AND TRADEMARK OFFICE

CERTIFICATE OF CORRECTION

PATENT NO. : 6,613,989 B2
DATED : September 2, 2003
INVENTOR(S) : Tatsuya Tsuda et al.

It is certified that error appears in the above-identified patent and that said Letters Patent is hereby corrected as shown below:

Title page,
Item [57], ABSTRACT
Line 1, please replace "includes (a) a case" with -- includes a case --.
Line 2, please replace "contacts; (b) a" with -- contacts; and a --.
Line 3, please replace "unit whose intermediate section is in" with -- unit with an intermediate section in --.
Line 4, please replace "contact, and a tip" with -- contact. A tip --.
Line 6, please replace "interval; (c) a spring placed" with -- interval. A spring is placed --.
Line 8, please replace "spring being in contact" with -- spring is in contact --.
Line 9, please replace "section extending from the moveable section being retained" to -- section of the spring extending from the movable section is retained --.
Line 10, please replace "case; (d) a cover with a hole for covering the case;" with -- case. A cover with a hole covers the case, --.
Line 11, please replace "(e) an operating unit having a depressing section, being" with -- an operating unit having a depressing section, is --.
Line 12, please replace "cover, and the" with -- cover. The --.
Line 13, please replace "extending through the hole of the cover for being" to -- extends through the hole of the cover so as to be --.

Signed and Sealed this

First Day of June, 2004

JON W. DUDAS
*Acting Director of the United States Patent and Trademark Office*